US007365689B2

(12) United States Patent
Lee

(10) Patent No.: US 7,365,689 B2
(45) Date of Patent: Apr. 29, 2008

(54) METAL INVERTED F ANTENNA

(75) Inventor: Chang-Jung Lee, Longtan Township, Taoyuan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/473,268

(22) Filed: Jun. 23, 2006

(65) Prior Publication Data

US 2007/0296636 A1 Dec. 27, 2007

(51) Int. Cl.
*H01Q 1/12* (2006.01)

(52) U.S. Cl. ..... 343/700 MS; 343/846

(58) Field of Classification Search ..... 343/702, 343/700 MS, 829, 846
See application file for complete search history.

(56) References Cited

U.S. PATENT DOCUMENTS 6,597,317 B2 * 7/2003 Talvitie ..... 343/700 MS
6,876,329 B2 * 4/2005 Milosavljevic ..... 343/700 MS
6,911,945 B2 * 6/2005 Korva ..... 343/702
6,985,108 B2 * 1/2006 Mikkola et al. ..... 343/700 MS
2005/0264455 A1 * 12/2005 Talvitie et al. ..... 343/702

* cited by examiner

*Primary Examiner*—Tho Phan
(74) *Attorney, Agent, or Firm*—Birch, Stewart, Kolasch & Birch, LLP

(57) ABSTRACT

The present invention discloses an antenna structure comprising a ground plane; a radiator having a curved shape portion and a rectangular portion connected to the ground plane via a first end of the curved shape portion and grounded by a ground point of the ground plane, the rectangular portion being connected to a second end of the curved shape portion; and a feed point projected into a groove within the ground plane and connected to the second end of the curved shape portion of the radiator; and wherein the ground plane is extended over the rectangular portion of the radiator.

14 Claims, 6 Drawing Sheets

METAL INVERTED F ANTENNA

FIELD OF THE INVENTION

The present invention relates generally to antenna structures, and more particularly to a metal inverted F antenna (IFA) with a feed point projected into a curved groove within the ground plane.

BACKGROUND OF THE INVENTION

As telecommunication technologies advance from wired to wireless communication driven by efficiency and convenience for the general public in the past decade, wireless communication devices and their implementation have become ubiquitous. Antennas have been a key building block in the construction of every wireless communication system. In many instances, the antenna is not considered critical in the initial system design. However, the antenna is the single device that allows RF energy to transmit between wired transmission lines and free space. Consequently, antennas and propagation are the key factors influencing the robustness and quality of the wireless communication channel.

Typically, conventional helical antennas or linear monopole antennas are used as antennas for portable terminals. The helical antennas or linear monopole antennas have a merit of omni-directional radiation characteristic, since they are of external type projecting outside the device, therefore, they are likely to be damaged by an external force.

One planar antenna called planar inverted F antenna (PIFA) having a low profile structure is employed as an internal antenna configured inside a mobile communication terminal. The conventional PIFA includes a radiating element, a coaxial wire and a ground plane. The radiating element is fed through the coaxial wire, and is connected to the ground plane so that an impedance match can be achieved. The conventional PIFA must be designed by taking into account the length L of the radiating element and the height of the antenna according to the width of the radiating element. The PIFA functions as a square-shaped micro-strip antenna with the length of the radiating unit reduced to half, achieving a low profile structure. Further the PIFA is an internal antenna installed in the mobile communication terminal, thereby being aesthetically designed and protected from external impact.

Further, the ground plane of the antenna plays a significant role in its operation. Excitation of currents in the printed IFA causes excitation of currents in the ground plane. The resulting electromagnetic field is formed by the interaction of the IFA and an image of itself below the ground plane. Its behavior as a perfect energy reflector is consistent only when the ground plane is infinite or very much larger in its dimensions than the monopole itself. In practice the metallic layers are of comparable dimensions to the monopole and act as the other part of the dipole.

Since the miniaturization method used in the conventional antenna is based on a two-dimensional structure, there is a limit to the miniaturization. The space for the antenna in the portable device is reduced day by day, there is a keen need of improvement for the miniaturization. There is still a need of improvement in view of a space use or a feeding efficiency.

However, wireless communication is characterized by limited available frequency spectrum, low transmission powers and limited device processing capability. Furthermore, narrow bandwidth characteristic of conventional PIFA is one of the limitations for its commercial application for wireless mobile at present.

SUMMARY OF THE INVENTION

One object of the present invention is to provide a plane antenna.

Another object of the present invention is to provide an F-shape antenna to increase the bandwidth.

Still another object of the present invention is to provide an antenna structure comprising a feed point projected into a center of the curved groove within the ground plane. In other words, the curved groove has an opening to receive the feed point in the center of the curved groove.

Yet another object of the present invention is to provide an antenna structure comprising a radiator having a curved shape portion and a rectangular portion connected to the ground plane such as to improve the performance of the antenna.

The present invention discloses an antenna structure comprising a ground plane; a radiator having a curved shape portion and a rectangular portion connected to the ground plane via a first end of the curved shape portion and grounded by a ground point of the ground plane, the rectangular portion being connected to a second end of the curved shape portion; and a feed point projected into a location of substantial center of a curved groove within the ground plane and connected to the second end of the curved shape portion of the radiator; wherein the ground plane is extended over the rectangular portion of the radiator. The rectangular portion of the radiator is substantially parallel to the ground plane.

The thickness of the above antenna structure is from 0.3 millimeter to 2 millimeter. The length of the rectangular portion of the radiator is about ¼ wavelength. The width of the rectangular portion of the radiator is from 1/20 to 1/50 wavelength. The radius of the outermost circle of the curved shape portion of the radiator is about 1/16 wavelength. The radius of the center hollow circle of the curved shape portion of the radiator is about 1/16 wavelength subtracting the width of the rectangular portion of the radiator.

The radius of the curved groove is greater than the width of the rectangular portion of the radiator. The height of the ground plane is greater than the radius of the curved groove. The length from one end, connected to the first end of the curved shape portion, to the curved groove is greater than the radius of the outermost circle of the curved shape portion of the radiator.

The aforementioned objects, features, and advantages will become apparent from the following detailed description of a preferred embodiment taken together with the accompanying drawings.

BRIEF DESCRIPTION OF THE DRAWINGS

A preferred embodiment of the invention will be illustrated further in the following description and accompanying drawings, and wherein.

DETAILED DESCRIPTION OF A PREFERRED EMBODIMENT

Figure 1:
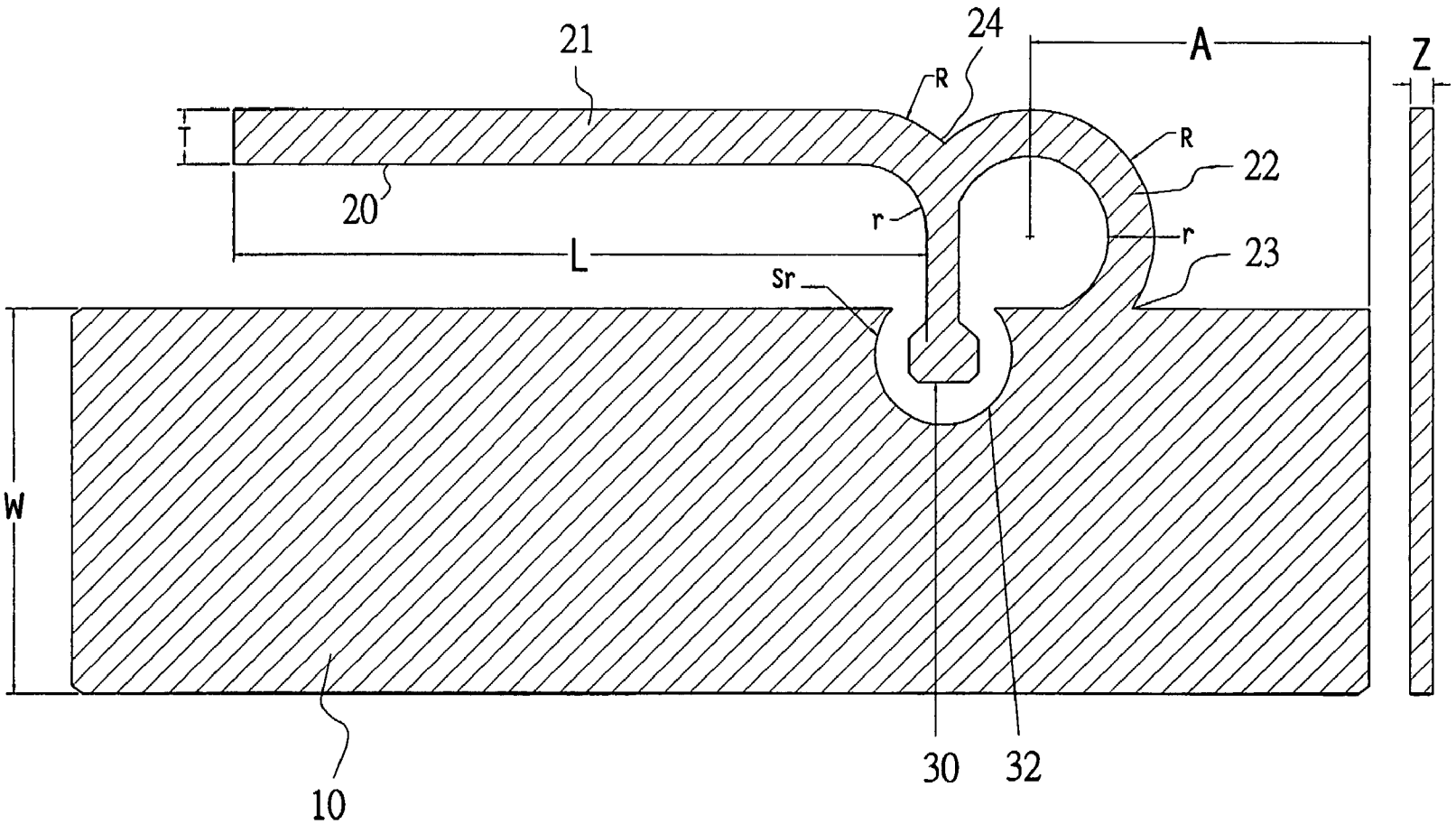
FIG. 1 is a horizontal schematic diagram of the planar metal inverted F antenna of the present invention.

The preferred embodiments of the present invention will be described in detail with reference to the annexed drawings. In the drawings, the same or similar elements are denoted by the same reference numbers even though they are depicted in different drawings. In the following description, a detailed description of known functions and configurations incorporated herein will be omitted when it may make the subject matter of the present invention rather unclear.

FIG. 1 is a horizontal schematic diagram of the planar metal inverted F antenna of the present invention. As shown in FIG. 1, a radiation element of the antenna is combined to a ground metal plane 10. The basic properties that are used to describe the performance of an antenna include impedance, voltage standing wave ratio (VSWR) or standing wave ratio (SWR), amplitude radiation patterns, directivity, gain, polarization and bandwidth.

In order to achieve maximum power transfer between a wire or coaxial transmission line and an antenna, the input impedance of the antenna must identically match the characteristic impedance of the transmission line. The ratio between the maximum voltage and the minimum voltage along the transmission line is defined as the VSWR. The VSWR, which can be derived from the level of reflected and forward waves, is also an indication of how closely or efficiently an antenna's terminal input impedance is matched to the characterized impedance of the transmission line. An increase in VSWR indicates an increase in the mismatch between the antenna and the transmission line.

Referring to FIG. 1, it shows a horizontal schematic diagram of the planar metal inverted F antenna of the present invention. The antenna structure comprises a ground plane 10. A radiator 20 having a curved shape portion 22 and a rectangular portion 21 is connected to the ground plane 10 via a first end 23 of the curved shape portion 22 and grounded by a ground point of the ground plane 10. The ground point constituting a grounding line is located substantially below the radiator 20. The feed point 30 is configured within a curved groove 32 on the ground plane 10. In other words, the ground plane 10 has the groove 32 toward to the feed point 30 to receive the feed point 30 at the location that is substantially center of the groove 32. It should be noted that any shape of the groove can be used. Further, the feed point 30 can be implemented as coaxial feed. The feed point 30 can also be implemented by placing it at the edge of the radiator 20. Furthermore, the radiator 20 includes the curved shape portion 22 and the rectangular portion 21. The feed point 30 is connected to a second end 24 of the curved shape portion 22. It is noted that the ground plane 10 is extended over the rectangular portion 21 of the radiator 20. The rectangular portion 21 of the radiator 20 is parallel to the ground plane 10.

The planar radiator is provided with a groove at the interface between the curved shape portion and the rectangular portion. Such a plane antenna structure is suitable for use in more than one frequency range. An open end of the rectangular portion 21 resides at the edge of the rectangular portion 21 of the radiator 20.

In order for the plane antenna to operate as desired, the curved shape portion 22 is placed between the ground plane 10 and the feed point 30, and the feed point 30 is projecting into the curved groove 32 within the ground plane 10. The rectangular portion 21 is projecting from the second end 24 of the curved shape portion 22. The ground plane 10 is extended over the rectangular portion 21, so that a sufficient platform can be provided by the ground plane 10 to engage with the transmission device, such as an access point (AP).

Furthermore, as the curved and rectangular radiating elements 21, 22 are connected to the common ground element, a compact internal antenna can be manufactured. Preferably, the feeding element 30 is arranged vertically to the radiator 20, and is projecting into the center of the curved groove 32 within the ground plane. However, when a ground condition based on the structure of the terminal equipped with the internal antenna is varied, some physical parameters between the feeding element, radiator and the ground can be varied so that the radiating element radiates the polarized waves of a predetermined band frequency, respectively. Furthermore, the radiating element can be a wire or planar radiating element, and can be variously modified.

The thickness of the above antenna structure is from 0.3 millimeter to 2 millimeter. The length of the rectangular portion 21 of the radiator 20 is about ¼ wavelength. Quarter wave means that the antenna length is ¼ of the wavelength of the operation frequency at which it is resonant. The width of the rectangular portion 21 of the radiator 20 is from 1/20 to 1/50 wavelength. The radius of the outermost circle of the curved shape portion 22 of the radiator 20 is about 1/16 wavelength. The radius of the center hollow circle of the curved shape portion 22 of the radiator 20 is about 1/16 wavelength subtracting the width of the rectangular portion 21 of the radiator 20. It shall be appreciated that the specific embodiment of the invention has been described herein for purposes of illustration rather than limiting the invention.

The radius of the curved groove 32 is greater than the width of the rectangular portion 21 of the radiator 20. Further, the diameter of the curved groove 32 is larger than the diameter of the feed point 30, and the feed point 30 can be received within the curved groove 32. The height of the ground plane 10 is greater than the radius of the curved groove 32. The length from one end, connected to the first end 23 of the curved shape portion 22, to the curved groove 32 is greater than the radius of the outermost circle of the curved shape portion 22 of the radiator 20.

Figure 2:
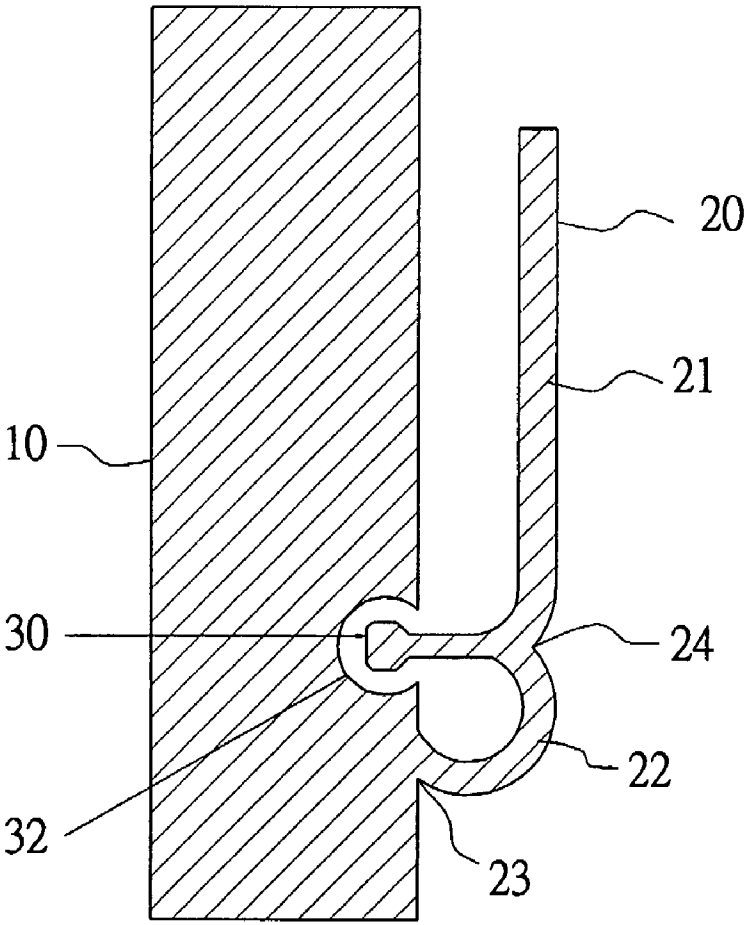
FIG. 2 is a vertical schematic diagram of the planar metal inverted F antenna of the present invention.

FIG. 2 illustrates a vertical schematic diagram of the planar metal inverted F antenna of the present invention. The radiator 20 can be placed vertically to combine to the transmission device, such as an AP. The position of the rectangular portion 21 is configured above the position of the curved portion 22.

Figure 3:
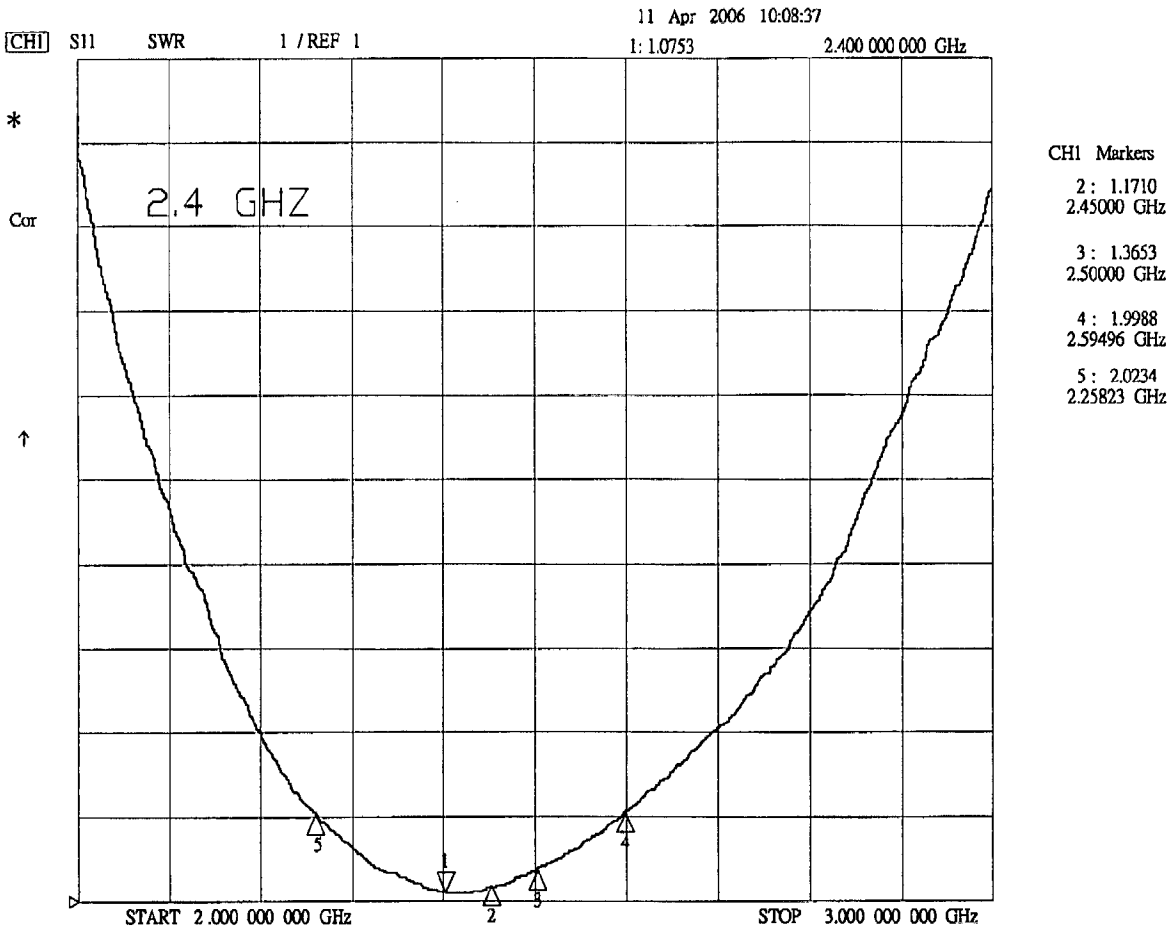
FIG. 3 is the SWR according to the present invention.

FIG. 3 shows the SWR illustration of the antenna. One of the basic properties to indicate the performance of an antenna includes the standing wave ratio (SWR). The SWR can be derived from the level of reflected and forward waves, is also an indication of how closely or efficiently an antenna's terminal input impedance is matched to the characterized impedance of the transmission line. From points 4 and 5 of the figure, the corresponding frequencies are respectively 2.59496 GHz and 2.25823 GHz. Thus, the bandwidth of the antenna is almost wider than 340 MHz. The performance of the antenna is pretty good.

Furthermore, the omni-directional behavior of the IFA with gain values that ensures adequate performance for typical indoor environments taking into account the standard values of the output power and receiver sensitivity of short range radio devices.

Figure 4:
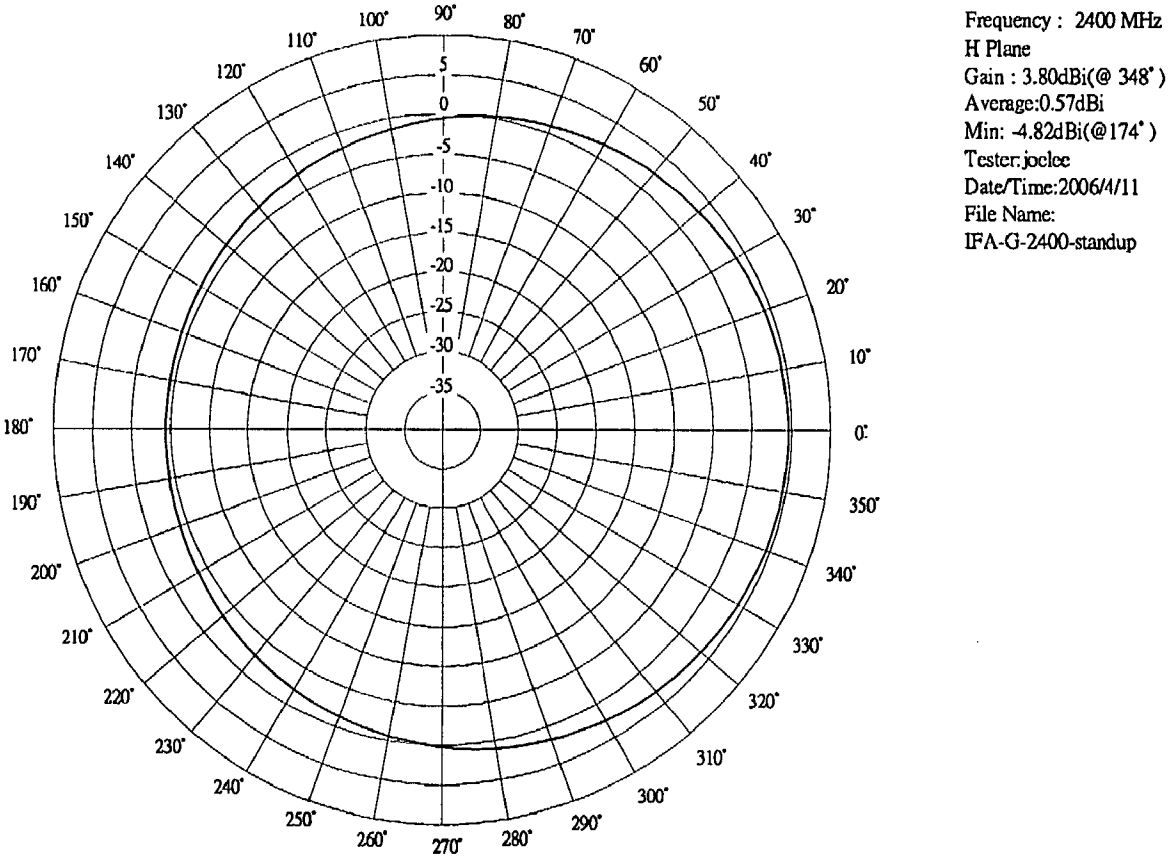
FIG. 4 is the radiation pattern in a resonant frequency of 2.4 GHz according to the present invention.
Figure 5:
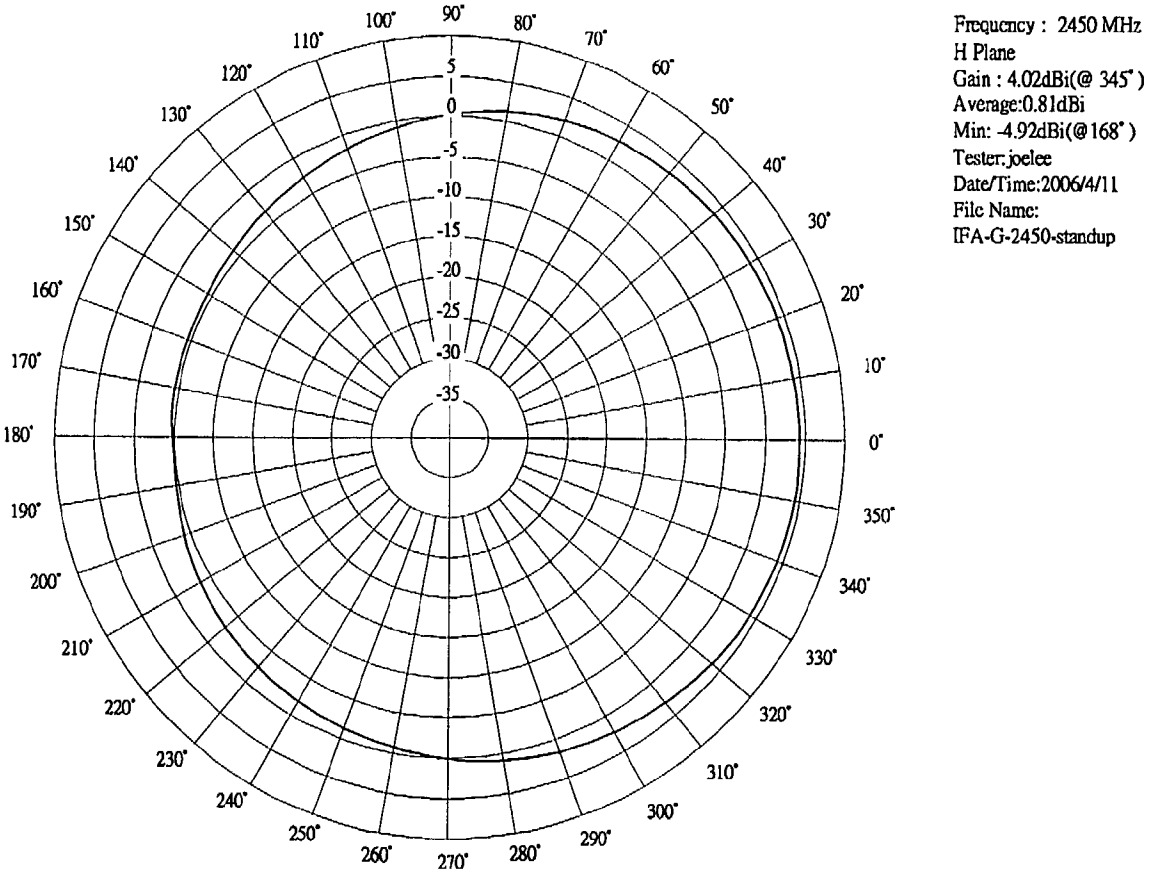
FIG. 5 is the radiation pattern in a resonant frequency of 2.45 GHz according to the present invention.
Figure 6:
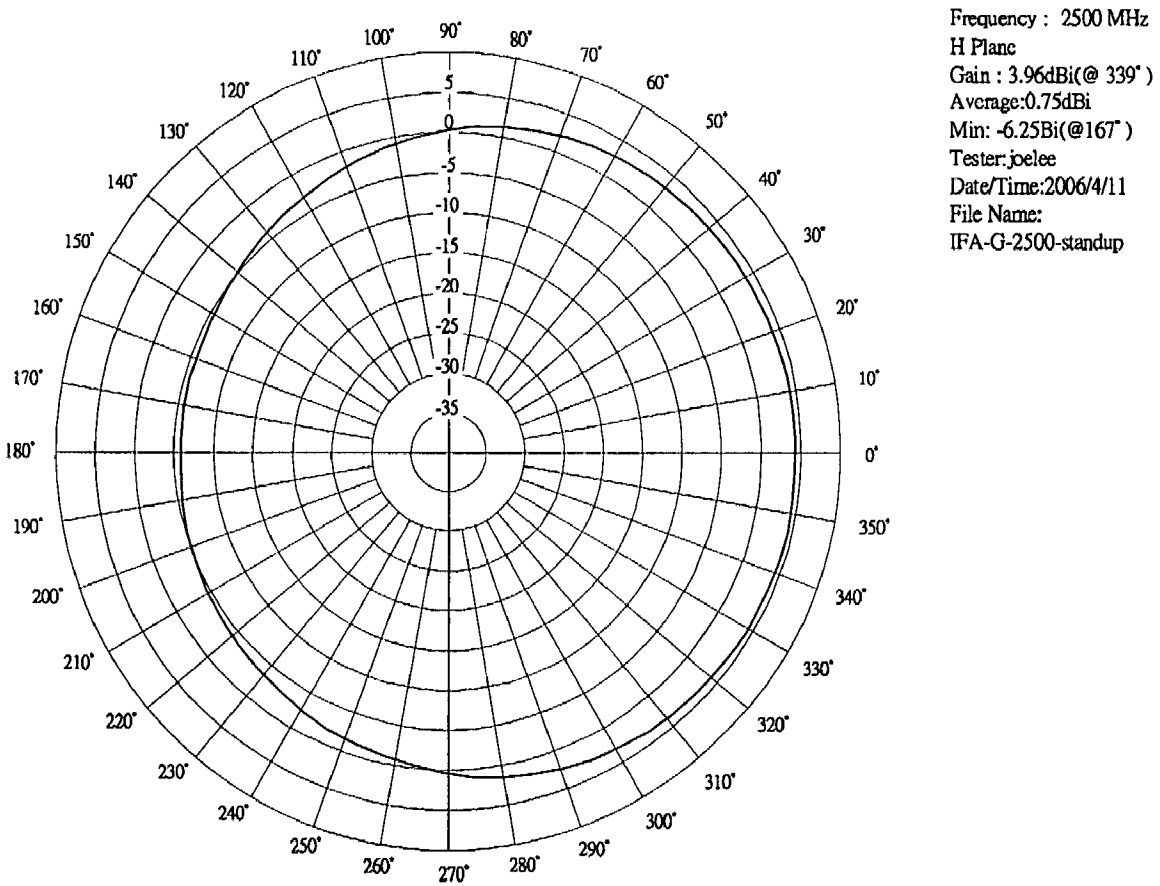
FIG. 6 is the radiation pattern in a resonant frequency of 2.5 GHz according to the present invention.

Referring to FIG. 4-6, there are shown radiation pattern of the antenna in accordance with the embodiment of the present invention in a resonant frequency of 2.4, 2.45 and 2.5 GHz, respectively. FIG. 4 shows H plane radiation pattern, wherein the gain is around 3.80 dBi at 348 degree and the average gain is 0.57 dBi. FIG. 5 shows H plane radiation pattern, wherein the gain is around 4.02 dBi at 345 degree and the average gain is 0.81 dBi. FIG. 6 shows H plane radiation pattern, wherein the gain is around 3.96 dBi at 339 degree and the average gain is 0.75 dBi. From a measurement result of a radiation pattern of an antenna designed and manufactured in the present invention using the rectangular and curved radiating element, it can be seen that a good radiation gain and an average gain of more than 0 dBi can be obtained. The radiation pattern of the inventive antenna in accordance with the embodiment of the present invention has the considerably improved efficiency of reception.

The advantage of the present invention is to provide an Inverted F Antenna (IFA) having the ability to receive both vertically and horizontally polarized electromagnetic waves, which can be proven beneficial in indoor environment where is sensitive to polarization.

PIFA mentioned by the present invention can be considered as a kind of linear Inverted F antenna (IFA) with the wire radiator element replaced by a plane to expand the bandwidth. One advantage of PIFA is that can be hiding into the housing of the mobile when comparable to whip/rod/helix antennas. Second advantage of PIFA is having reduced backward radiation toward the user's head, minimizing the electromagnetic wave power absorption (SAR) and enhances antenna performance. Third advantage is that PIFA it exhibits moderate to high gain in both vertical and horizontal states of polarization. This feature is very useful in certain wireless communications where the antenna orientation is not fixed and the reflections are present from the different corners of the environment. In those cases, the important parameter to be considered is the total field that is the vector sum of horizontal and vertical states of polarization.

From the foregoing description details, it shall be appreciated that specific embodiments of the invention have been described herein for purposes of illustration, but that various modifications may be made by those skilled in the art without deviating from the spirit and scope of the invention. Accordingly, the invention is not limited except as by the appended claims.

The invention claimed is:

1. An antenna structure comprising:

a ground plane;

a radiator having a curved shape portion and a rectangular portion connected to said ground plane via a first end of said curved shape portion and grounded by a ground point of said ground plane, said rectangular portion being connected to a second end of said curved shape portion; and a feed point projected into a groove within said ground plane and connected to said second end of said curved shape portion of said radiator; and wherein said ground plane is extended over said rectangular portion of said radiator.

2. The antenna structure of claim 1, wherein said rectangular portion of said radiator is parallel to said ground plane.

3. The antenna structure of claim 1, wherein the thickness of said antenna structure is from 0.3 millimeter to 2 millimeter.

4. The antenna structure of claim 1, wherein the length of said rectangular portion of said radiator is about ¼ wavelength.

5. The antenna structure of claim 1, wherein the width of said rectangular portion of said radiator is from 1/20 to 1/50 wavelength.

6. The antenna structure of claim 1, wherein the radius of the outermost circle of said curved shape portion of said radiator is about 1/16 wavelength.

7. The antenna structure of claim 1, wherein the radius of the center hollow circle of said curved shape portion of said radiator is about 1/16 wavelength subtracting the width of said rectangular portion of said radiator.

8. The antenna structure of claim 1, wherein the height of said ground plane is greater than the radius of said groove.

9. The antenna structure of claim 1, wherein said curved shape portion is in the shape of a circle intersecting the ground plane.

10. The antenna structure of claim 1, wherein the groove has a cross section in the shape of a truncated circle, the groove having an opening on the ground plane which is smaller than a diameter of the groove.

11. The antenna structure of claim 1, wherein the radiator has a groove at an interface between the curved shape portion and the rectangular portion.

12. The antenna structure of claim 1, wherein said feed point projects into said groove and does not contact an inside surface of said groove.

13. An antenna structure comprising:

a ground plane;

a radiator having a curved shape portion and a rectangular portion connected to said ground plane via a first end of said curved shape portion and grounded by a ground point of said ground plane, said rectangular portion being connected to a second end of said curved shape portion; and a feed point projected into a groove within said ground plane and connected to said second end of said curved shape portion of said radiator; and wherein said ground plane is extended over said rectangular portion of said radiator; and wherein the radius of said groove is greater than the width of said rectangular portion of said radiator.

14. An antenna structure comprising:

a ground plane;

a radiator having a curved shape portion and a rectangular portion connected to said ground plane via a first end of said curved shape portion and grounded by a ground point of said ground plane, said rectangular portion being connected to a second end of said curved shape portion; and a feed point projected into a groove within said ground plane and connected to said second end of said curved shape portion of said radiator; and wherein said ground plane is extended over said rectangular portion of said radiator; and wherein the length from one end, connected to said first end of said curved shape portion, to said groove is greater than the radius of the outermost circle of said curved shape portion of said radiator.

* * * * *